US008490820B2

(12) United States Patent
Heighington

(10) Patent No.: US 8,490,820 B2
(45) Date of Patent: Jul. 23, 2013

(54) MODULAR APPARATUS FOR PRODUCTION TESTING

(75) Inventor: Larry James Heighington, Whitecourt (CA)

(73) Assignee: Nabors Canada, Calgary (CA)

( * ) Notice: Subject to any disclaimer, the term of this patent is extended or adjusted under 35 U.S.C. 154(b) by 873 days.

(21) Appl. No.: 11/940,390

(22) Filed: Nov. 15, 2007

(65) Prior Publication Data

US 2009/0127270 A1 May 21, 2009

(51) Int. Cl.
*F17C 1/00* (2006.01)
*F17C 5/02* (2006.01)

(52) U.S. Cl.
USPC ..... 220/560.09; 220/1.5; 220/560.11; 220/581; 220/636; 206/386

(58) Field of Classification Search
USPC ..... 220/23.83, 560.09, 560.11, 1.5, 581, 220/636, 584; 206/386; 73/152.42
See application file for complete search history.

(56) References Cited

U.S. PATENT DOCUMENTS

| | | | | | |
|---|---|---|---|---|---|
| 2,706,575 | A | * | 4/1955 | Soherr | 220/560.1 |
| 2,938,644 | A | * | 5/1960 | Cavalier et al. | 220/584 |
| 3,792,795 | A | | 2/1974 | Sikora et al. | |
| RE29,424 | E | * | 10/1977 | Bognaes et al. | 62/53.2 |
| 4,086,864 | A | * | 5/1978 | Ito | 114/74 A |
| 4,126,099 | A | * | 11/1978 | Lange | 114/74 A |
| 4,343,409 | A | * | 8/1982 | Silver | 220/675 |
| 5,090,238 | A | * | 2/1992 | Jones | 73/152.42 |
| 7,475,796 | B2 | * | 1/2009 | Garton | 222/185.1 |
| 2002/0166861 | A1 | * | 11/2002 | Hinkle et al. | 220/562 |
| 2008/0164251 | A1 | * | 7/2008 | Fawley | 220/1.5 |

* cited by examiner

*Primary Examiner* — Mickey Yu
*Assistant Examiner* — Niki Eloshway
(74) *Attorney, Agent, or Firm* — Bennett Jones LLP

(57) ABSTRACT

An apparatus for production testing. According to one aspect, the apparatus is modular and suitable for transport and assembly in the field. The apparatus comprises a platform and one or more pressure vessels. The platform includes a mounting bracket for the pressure vessel and the mounting bracket includes a guide mechanism. The guide mechanism allows the pressure vessel to be lowered into the mounting bracket and coupled to the platform for example using a load sling on a helicopter. According to another aspect, the pressure vessels comprise spherical containers and the spherical containers are configured to be heliportable to a field site.

10 Claims, 12 Drawing Sheets

MODULAR APPARATUS FOR PRODUCTION TESTING

FIELD OF THE INVENTION

The present application relates to the oil and gas well testing, and more particularly to a modular apparatus for production testing.

BACKGROUND OF THE INVENTION

Production well testing comprises a process for acquiring data on new and existing wells, for example, oil and gas wells. The types of determinations that may be made by well operators include: geophysical boundaries, flow rates, maximum flow rate, zone permeability, reservoir pressure, gas and effluent sampling, and zonal contribution.

Production well testing apparatus typically comprises a cylindrical pressure vessel separator configured in either a horizontal or a vertical orientation. The pressure vessel can be used in a number of exploratory and remedial applications, including the following: formation effluent clean-up, well bleed-off, pipeline bleed-off, well start-up, gas flaring, workovers and under balanced drilling.

Production well testing equipment is typically configured on a skid or as a trailer mount unit which is transported via heavy duty truck tractors on established road networks proximate to the well site. Because of the requirement for road transportation, there are also seasonal limitations for dry seasons or winter periods when the ground is frozen. For example, in northern climes, such as Canada or Alaska, temporary roads may be built over the frozen ground or lakes in the winter.

It will be appreciated that the seasonal restrictions on the movement of production well testing equipment using conventional techniques gives rise to a number of problems for well operators including, limited availability of service companies for production well testing, dealing with extreme weather conditions, higher costs and the over-extension of operational and logistical resources, diminished productivity.

Accordingly, there remains a need for improvements to address the shortcomings associated with conventional production testing equipment in the art.

BRIEF SUMMARY OF THE INVENTION

The present application comprises a modular apparatus for production testing. According to one aspect, the apparatus is suitable for transport and assembly in the field. According to another aspect, the apparatus comprises one or more substantially spherical pressure vessels. According to another aspect, the apparatus comprises one or more semi-spherical pressure vessels.

According to one embodiment, the present invention provides a modular apparatus for production testing at a field site, the apparatus comprises: a platform, the platform including one or more mounting brackets; one or more pressure vessels, each of the one or more pressure vessels including a support member for each of the one or more mounting brackets; and each of the one or more mounting brackets includes a guide configured to guide the support member into position from an elevated position.

According to another embodiment, the present invention provides a production testing apparatus comprising: a platform having one or more mounting brackets; and one or more spherical pressure vessels, each of the one or more spherical pressure vessels including a mounting member for a corresponding one of each of the one or more mounting brackets.

According to yet another embodiment, the present invention provides a method for assembling a modular production testing apparatus at a field site, the modular production testing apparatus includes a platform and one or more pressure vessels, the method comprises the steps of: locating the platform at the field site; suspending each one of the pressure vessels above the platform; aligning the pressure vessel above a guide mechanism on the platform; lowering the pressure vessel onto the guide mechanism to a seated position.

Other aspects and features according to the present application will become apparent to those ordinarily skilled in the art upon review of the following description of embodiments of the invention in conjunction with the accompanying figures.

BRIEF DESCRIPTION OF THE DRAWINGS

Reference will now be made to the accompanying drawings which show, by way of example, embodiments according to the present application, and in which:

FIG. 2(*b*) is a side view of the base or platform of FIG. 1 according to an embodiment of the present invention;

FIG. 2(*c*) is an end view of the base or platform of FIG. 1 according to an embodiment of the present invention;

FIG. 3(*b*) is a top view of the base or platform of FIG. 3(*a*) according to an embodiment of the present invention;

FIG. 3(*c*) is a side view of the base or platform of FIG. 3(*a*) according to an embodiment of the present invention;

FIG. 3(*d*) is an end view of the base or platform of FIG. 3(*a*) according to an embodiment of the present invention;

Like reference numerals indicate like or corresponding elements in the drawings.

DETAILED DESCRIPTION OF THE EMBODIMENTS

Figure 1:
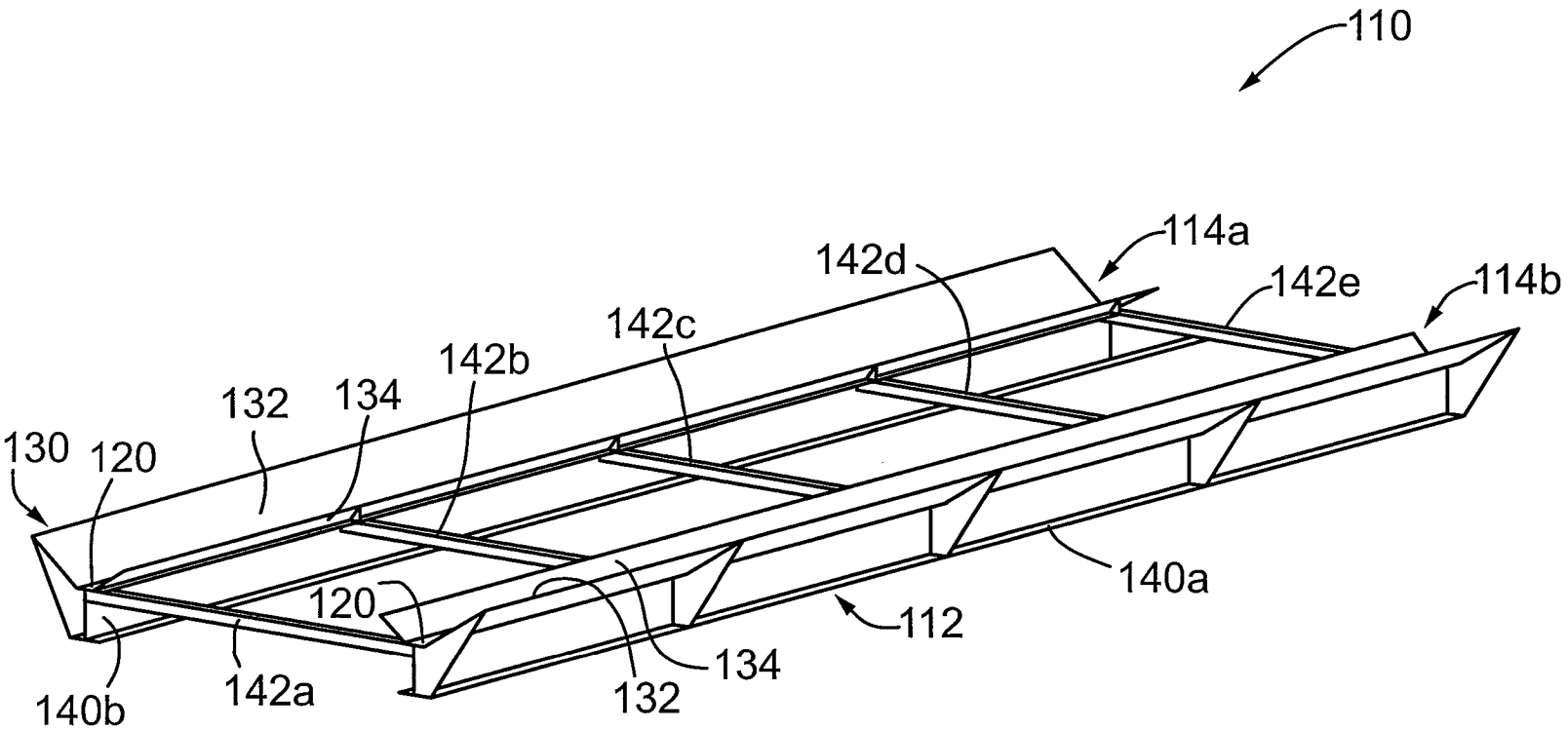
FIG. 1 shows a platform or base for a modular apparatus for production testing according to an embodiment of the present invention.
Figure 2A:
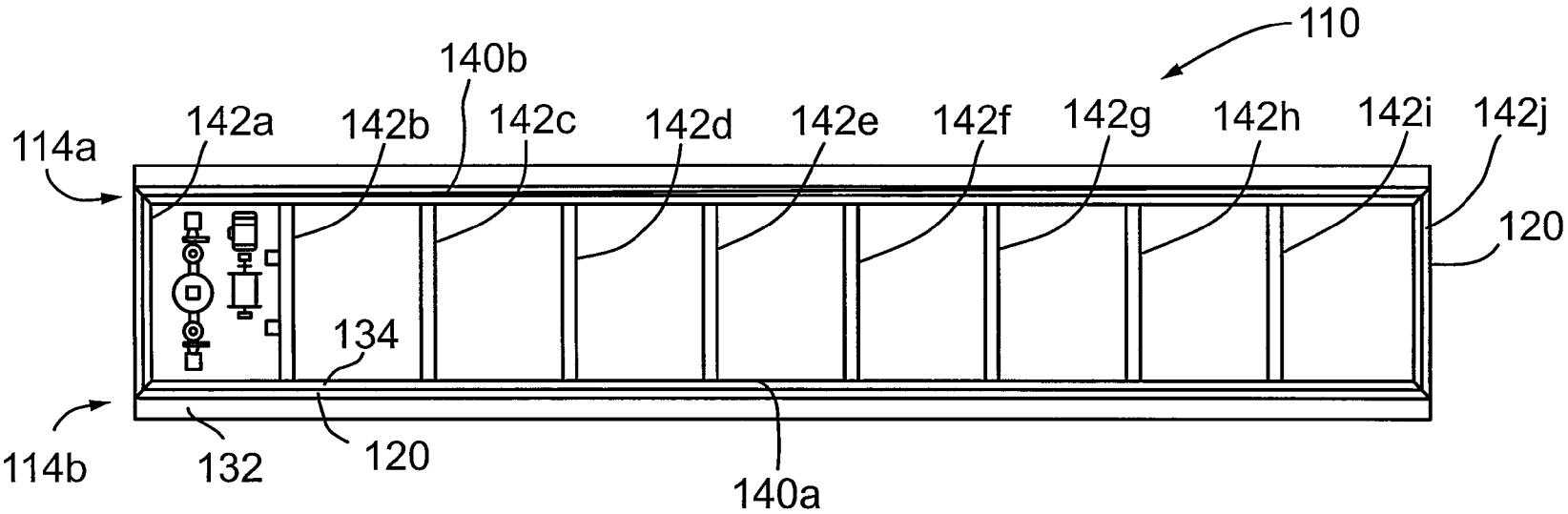
FIG. 2(*a*) is a top view of the base or platform of FIG. 1 according to an embodiment of the present invention.
Figure 2B:
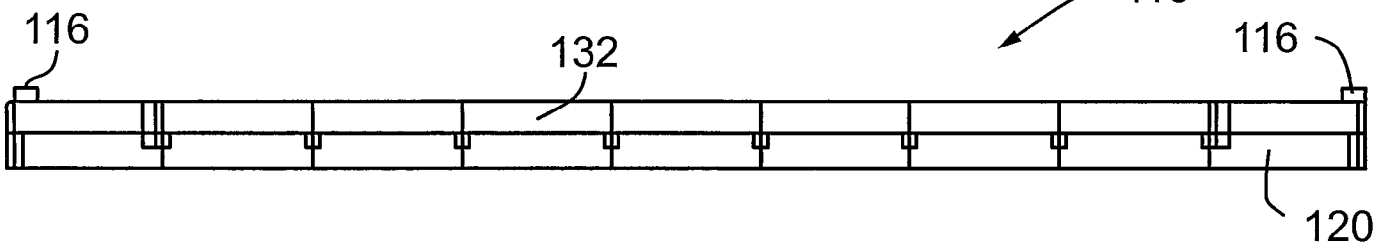
Figure 2C:
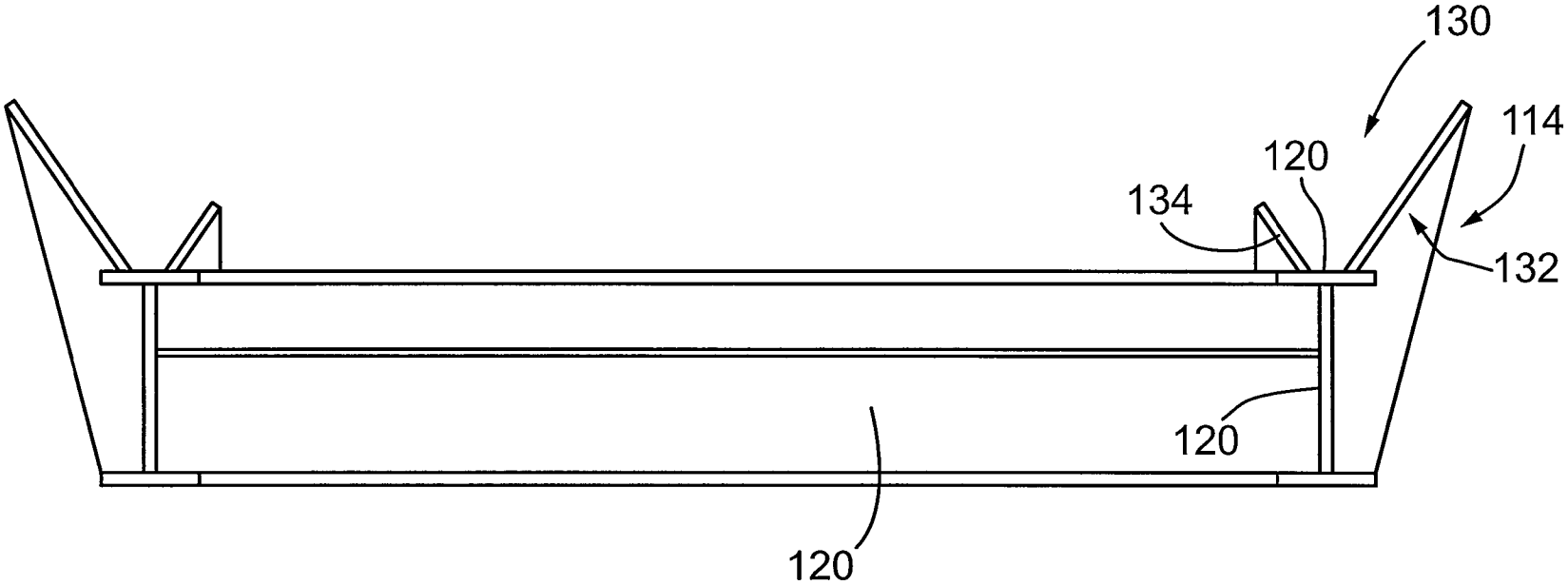
Figure 3A:
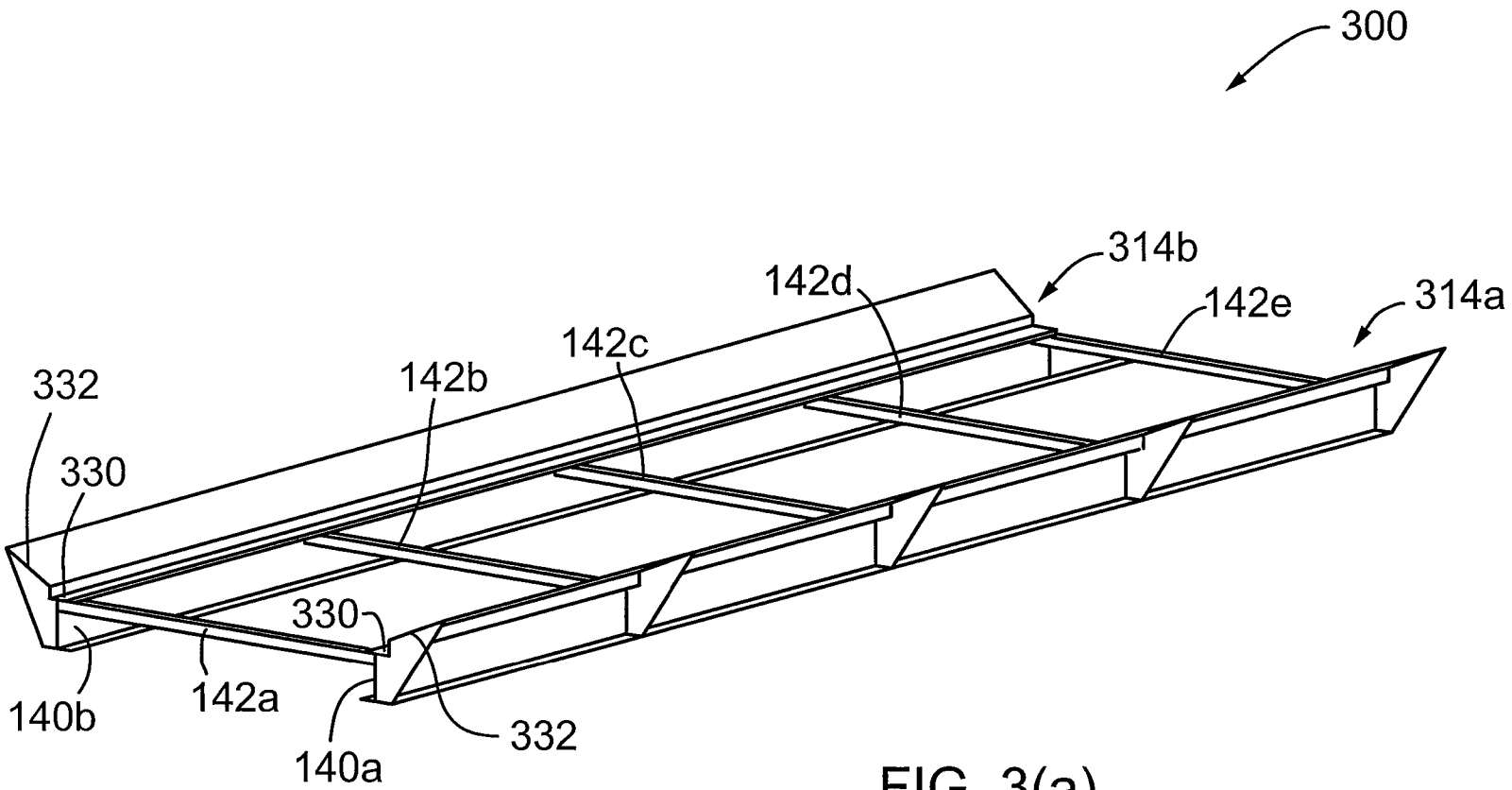
FIG. 3(*a*) shows a platform or base for a modular apparatus for production testing according to another embodiment of the present invention.
Figure 3B:
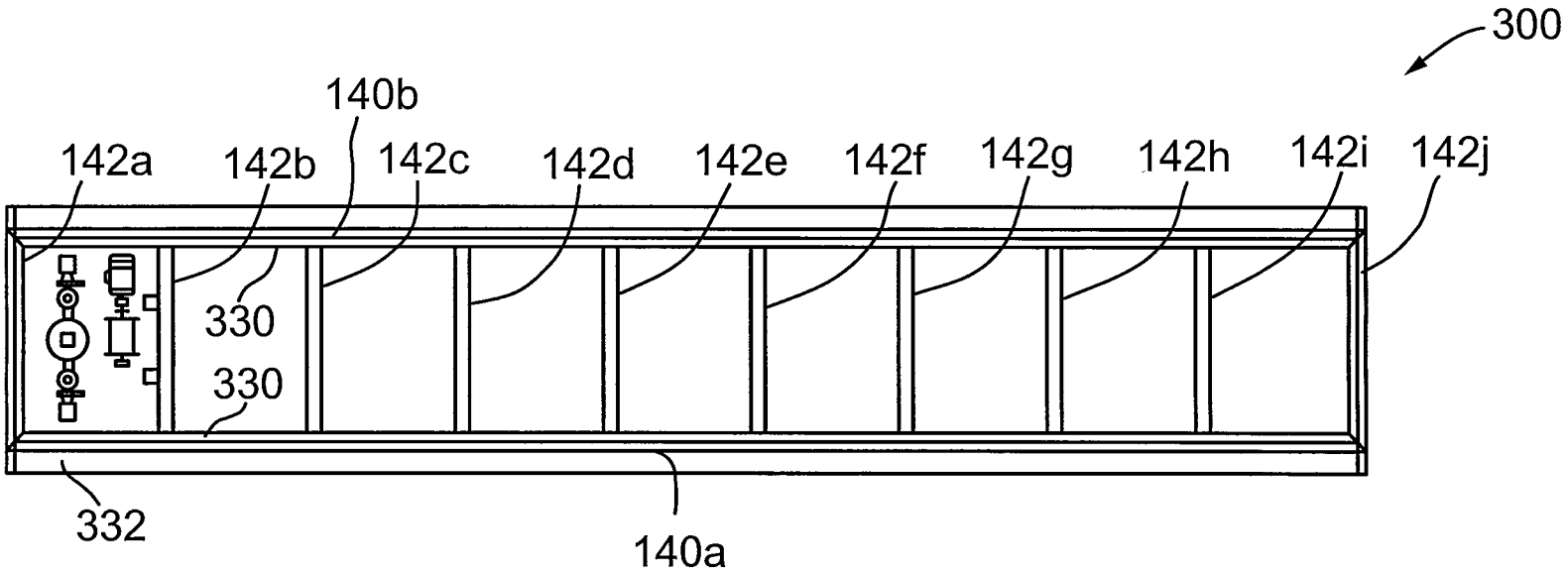
Figure 3C:
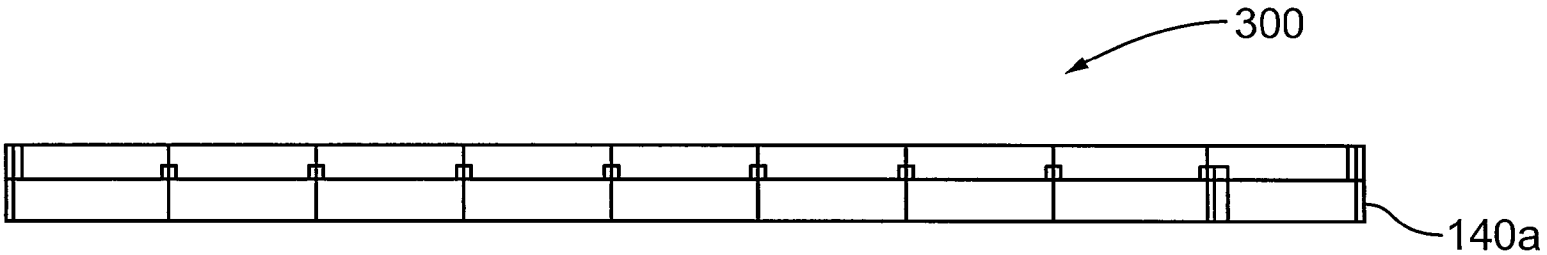
Figure 3D:
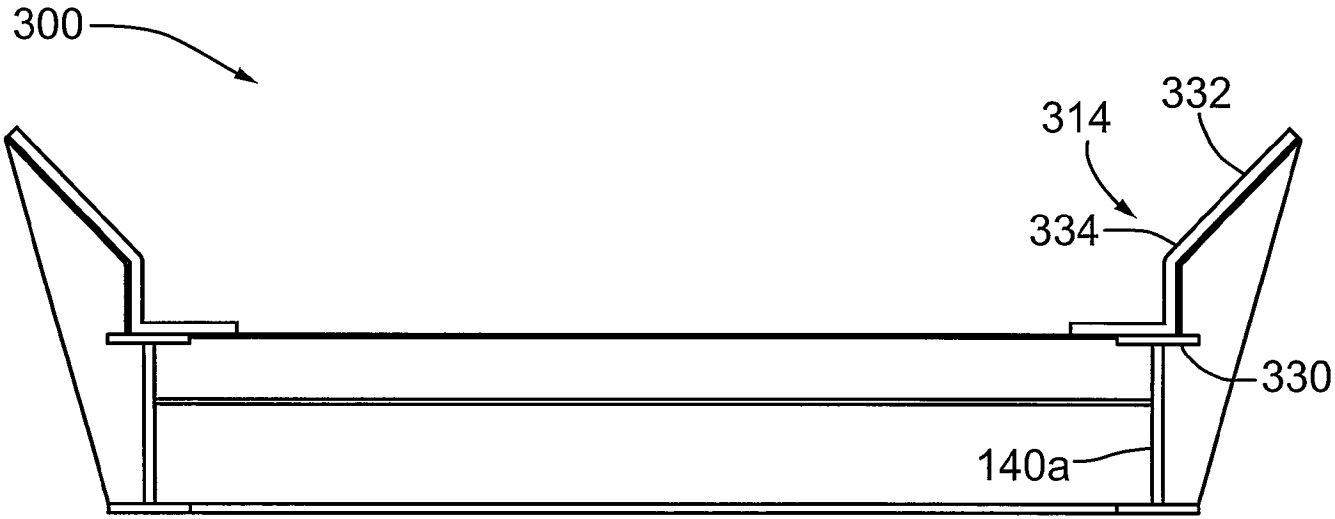
Figure 4:
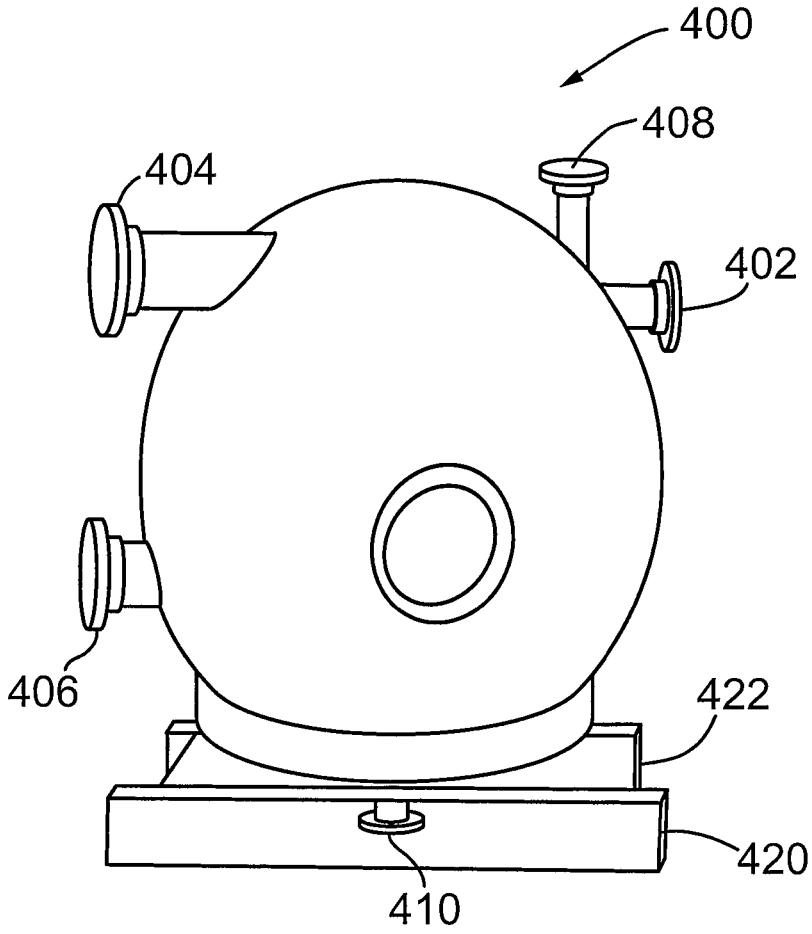
FIG. 4 shows in diagrammatic form a spherical vessel for a modular apparatus according to an embodiment of the invention.
Figure 5:
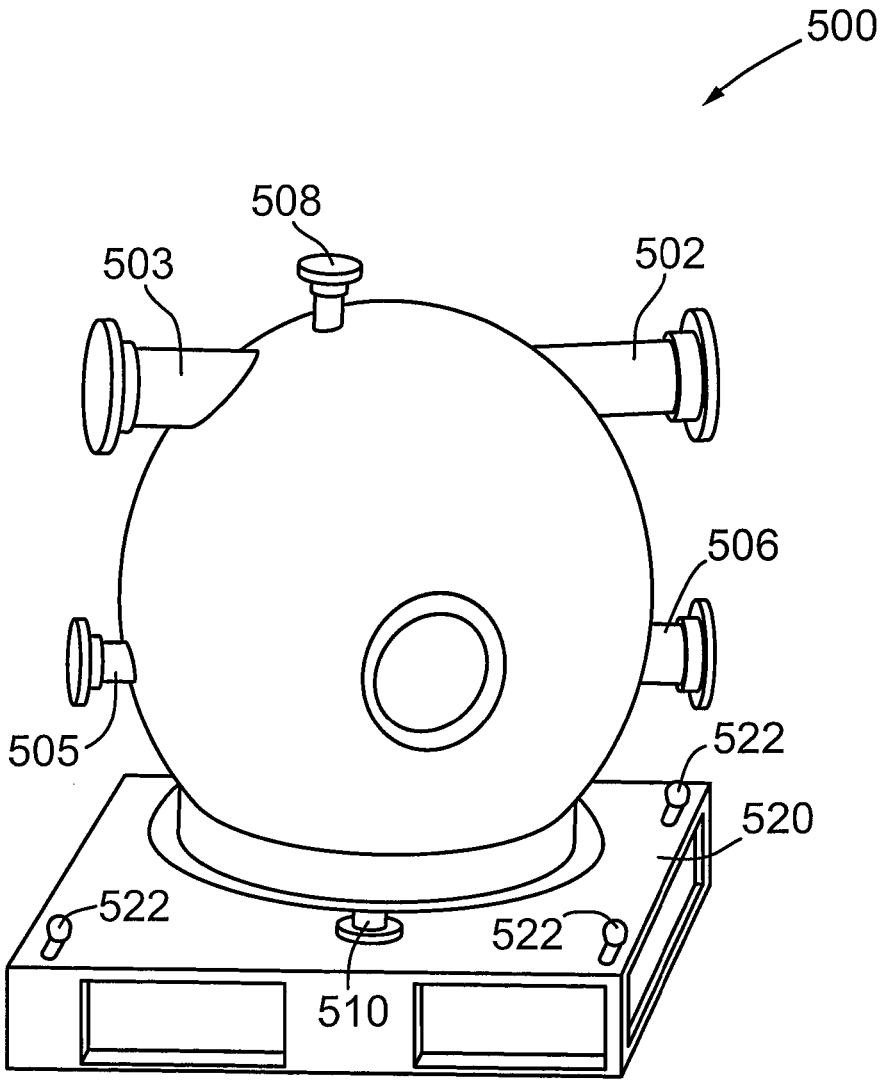
FIG. 5 shows in diagrammatic form a spherical vessel for a multiple vessel implementation of a modular apparatus according to an embodiment of the invention.
Figure 6:
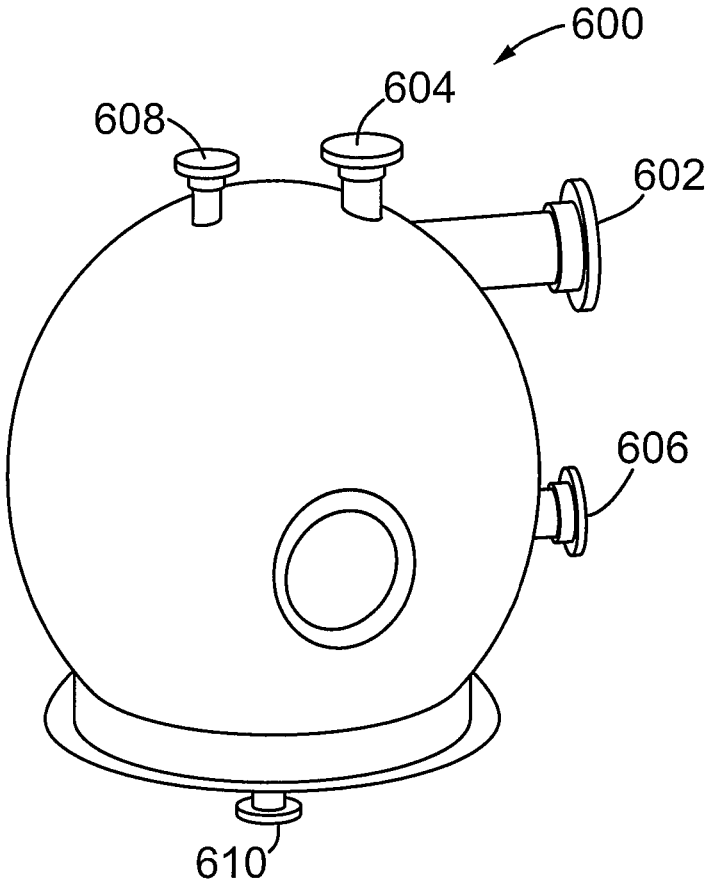
FIG. 6 shows in diagrammatic form a spherical vessel for a multiple vessel implementation of a modular apparatus according to an embodiment of the invention.

The present invention is directed to embodiments of a modular apparatus for production testing according. The modular production testing apparatus comprises a base (i.e. skid) or platform 110, according to one embodiment, as shown in FIGS. 1-2 and one or more pressure vessels 400, for example, as shown in FIGS. 4 to 6. According to one embodiment, the pressure vessel(s) 400 (500, 600) comprises a spherical tank as shown in FIG. 4 (FIGS. 5 and 6) and described in more detail below. According to another embodiment, the pressure vessel 400 comprises a semi-spherical tank design.

Referring to FIGS. 1 to 2, the base or platform 110 comprises a tank alignment insert or guide mechanism and support member for mounting one or more of the pressure vessels. As shown, the base or platform 110 comprises a base member 112 and one or more mounting brackets 114, indicated individually by references 114*a* and 114*b*, respectively. The mounting brackets 114 are configured to receive and hold the base or support members 420 and 422 of the pressure vessel 400, for example, as shown in FIG. 4. As shown in FIGS. 1 and 2(*a*), the base member 112 may be constructed as a frame comprising longitudinal members 140, indicated individually by references 140*a* and 140*b* in FIG. 1, and cross members 142, indicated individually by references 142*a*, 142*b*, 142*c*, 142*d* and 142*e* in FIG. 1. The longitudinal members 140 and the cross members 142 may comprise structural steel or aluminum components which are welded or fastened together using other known techniques. The base member 112 depicted in FIG. 2 is configured for three pressure vessels (for example, pressure vessels 400, 500 and 600 as shown in FIGS. 4, 5 and 6, respectively) and as such comprises extended longitudinal members 140 and includes additional cross members 142*f*, 142*g*, 142*h*, 142*i* and 142*j*. As also shown in FIG. 2(*b*), the base 110 also includes a lug 116 at each corner. The lugs 116 are configured to receive an eye-bolt or other fasteners suitable for attaching a sling or lifting hooks. The pressure vessels 400, 500, 600 also attachment points for a sling, hook or other lifting mechanism, for example, attachment rings 522 as shown in FIG. 5. According to one aspect, this configuration allows the base to be easily lifted or maneuvered, for example, onto a flat bed trailer, and also makes it suitable for transport by helicopter to remote locations or sites not readily accessible by road or ground transport.

According to an embodiment of the invention, each of the mounting brackets 114 comprises a trough or guide configuration which is dimensioned to receive and seat a corresponding base support member 420, 422 (for example, a rail) on the pressure vessel 400 depicted in FIG. 4, and described in more detail below. As shown in FIG. 1 and FIG. 2(*c*), each of the mounting brackets 114 comprises a support base 120 and an insert or alignment member 130. According to one embodiment, the insert or alignment member 130 comprises a pair of outwardly slanting or angled walls or members indicated by references 132 and 134, respectively. The V-shaped trough formed by the angled walls 132 and 134 serve to guide or align the pressure vessel on the platform 110, i.e. by moving the base or rail members of the vessel into alignment with the support base 120, as the vessel is being lowered, for example, by a crane or by a sling attached to a helicopter. As the pressure vessel is lowered the angled walls 132, 134 function to guide the pressure vessel into position until the base support member (e.g. rails 420 and 422 in FIG. 4) is seated or resting on the support base 120. According to this embodiment the base support members or rails on the base of the pressure vessel are aligned in parallel, i.e. along the longitudinal axis of the mounting brackets 114. According to another embodiment, the alignment member 130 comprises a single outwardly slanting or angled wall as described in more detail below with reference to FIG. 3.

Referring back to FIG. 1, the angled configuration of the mounting brackets 114 further facilitates the assembly of the apparatus 100 in the field. For example, the platform 110 is transported by helicopter, i.e. "heliported", to the field site and placed on the ground. Next, the spherical pressure vessel 400 is heliported to the site and the vessel 400 is positioned over the platform 110, lined up with the mounting brackets 114 and lowered into place. The configuration of the mounting brackets 114 (i.e. the outwardly angled walls) allow the pressure vessel 400 to be guided into place under the force of gravity and with minimal intervention or guiding by personnel positioned under the helicopter, which as will be appreciated can be a dangerous working environment or situation. It will be appreciated that according to one aspect, the self aligning insertion brackets 114 and the mounting or seating trough facilitate the positioning and mounting of the individual pressure vessels thereby improving worker safety while working under suspended loads. The platform 110 depicted in FIGS. 1 to 3 is configured for a three pressure vessel application, for example, as described in more detail below with reference to FIGS. 7 to 9. According to another embodiment, the platform 110 may be configured for single vessel configuration. To facilitate the transport and assembly, the pressure vessels also include multiple lift point attachments, for example, lugs or fastening means for accepting eye-bolts or other types of connectors for lifting the vessels, for example, on a sling under a helicopter.

Reference is next made to FIGS. 3(*a*) to 3(*d*) which depict a platform or skid according to another embodiment of the invention. The platform or skid is indicated generally by reference 300, and similar to the platform 110 described above, the platform 300 comprises a pair of longitudinal members 140*a* and 140*b* and frame or cross members 142*a* to 142*j*. The platform or skid 300 includes mounting brackets 314, indicated individually by references 314*a* and 314*b*, respectively. The mounting brackets 314 are configured to receive and hold the base or support members 420 and 422 of the pressure vessel 400, for example, as shown in FIG. 4, or a base member 520 as shown in FIG. 5 for the pressure vessel 500. In accordance with this embodiment, the mounting brackets 314 comprise a support base 320 and a guide or alignment member 330. According to this embodiment, the guide or alignment member 330 comprises a single outwardly slanting or angled wall or member indicated by references 332. The outwardly slanting or angled wall 332 forms a slope which functions to guide or align the pressure vessel on the platform 300, i.e. by moving the base or rail members of the vessel into alignment with the support base 320, as the vessel is being lowered, for example, by a crane or by a sling attached to a helicopter. As the pressure vessel is lowered, the rails of the pressure vessel slide along the angled wall 332 into position until the rails are seated or resting on the respective support bases 320.

As shown in FIG. 3(*d*), the mounting brackets 314 for the platform 300 may include an insert 334 according to an embodiment. The insert 334 may be formed from a plate of steel or other structural material which is then hardened or otherwise treated for abrasion resistance and durability. As shown, the hardened insert 334 can be formed to extend across the angled wall 332 and down across the support base 330. According to another embodiment, the insert 334 may comprise two separate plates or sections, with one section fastened to the angled wall 332 and the other section fastened to the support base 330. According to another embodiment, the insert 334 is fastened or attached to the mounting bracket 314 with removable fasteners, such as bolts, to provide the capability to replace the insert 334 for wear and tear. According to another embodiment, an insert may be provided for the mounting brackets 114 described above the platform 110 of FIG. 1.

Figure 7:
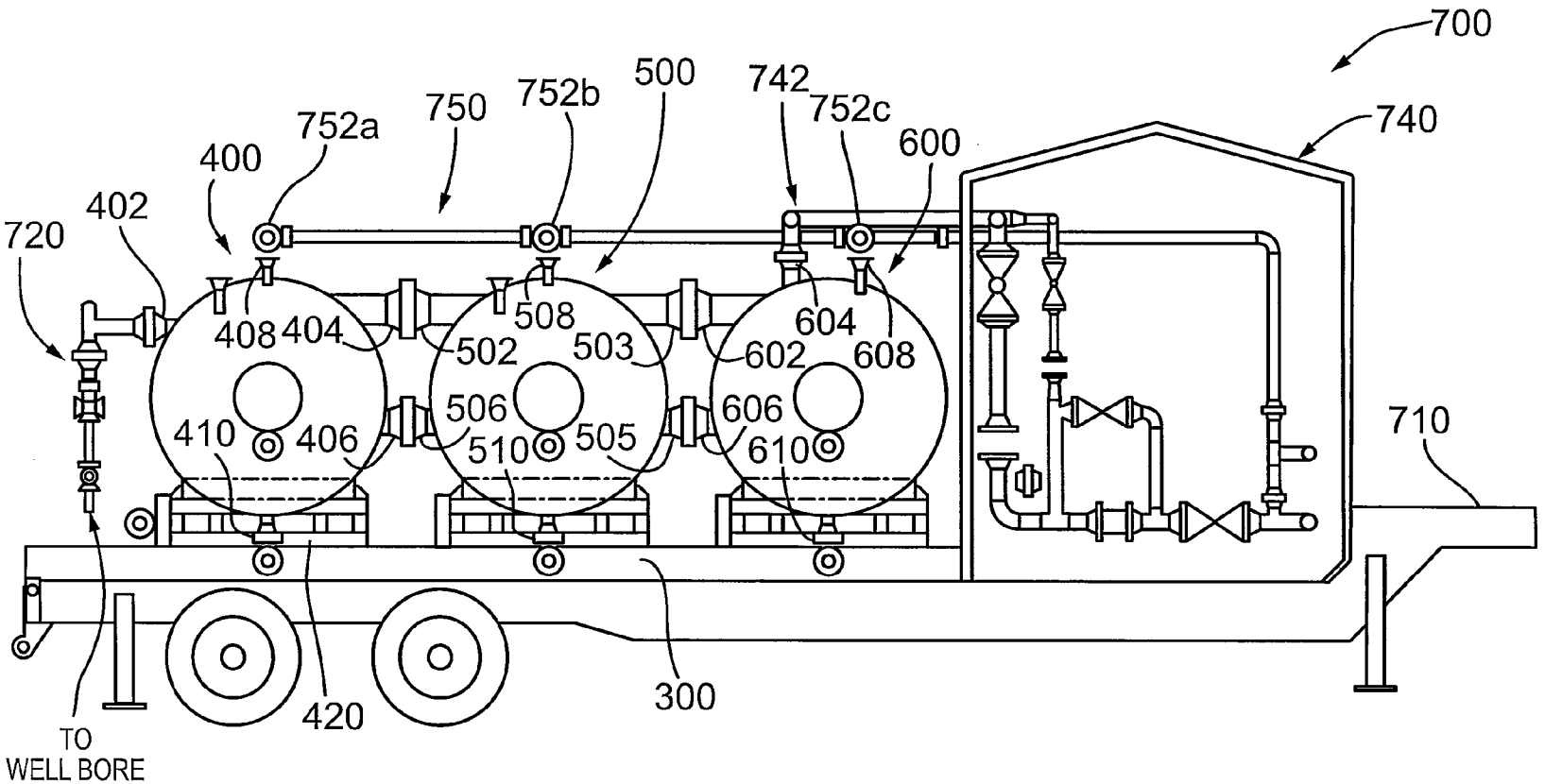
FIG. 7 shows in schematic form a modular apparatus having an arrangement of three spherical vessels according to an embodiment of the invention.

Reference is next made to FIG. 4, which shows a pressure vessel according to an embodiment of the invention. The pressure vessel is indicated generally by reference 400 and according to an embodiment comprises a spherical configuration or vessel. As shown and according to an embodiment, the spherical pressure vessel 400 includes an inlet connection flange 402, for coupling to output line, for example, on a well-bore for an oil or a gas well. The spherical pressure vessel 400 includes a connection flange 404 and a connection flange 406 for connecting to a mating pressure vessel in a multi-vessel configuration 700 for example as shown in FIG. 7. As shown, the spherical pressure vessel 400 also includes a Pressure Safety Valve or PSV connection flange 408, and a drain connection flange 410. The pressure safety valve prevents the vessel from being over pressured, i.e. beyond its Maximum Pressure Rating or MPR. For the three vessel configuration of FIG. 7, the pressure safety value would be set around 740 psi. The pressure safety valves are typically coupled or "tied" into a "Gas Out" or flare line in order to contain any hydrocarbons that may be released, i.e. prevent the hydrocarbons from being released into the atmosphere.

Reference is next made to FIG. 5, which shows a pressure vessel suitable for a multiple vessel configuration according to an embodiment of the invention. The pressure vessel is indicated generally by reference 500 and comprises a spherical configuration. According to an embodiment, the spherical pressure vessel 500 is intended to couple between the pressure vessel 400 (FIG. 4) and another pressure vessel 600 (FIG. 6) in a multiple vessel configuration or arrangement 700 as depicted in FIG. 7. As shown in FIG. 5, the spherical pressure vessel 500 includes a connection flange 502 and a connection flange 504. As shown in FIG. 7, the connection flanges 502 and 504 couple or connect to the corresponding connection flanges 404 and 406 on the spherical pressure vessel 400 (FIG. 4). The spherical pressure vessel 500 includes a PSV connection flange 508, and a drain connection flange 510. In order to couple with a second pressure vessel (for example, the pressure vessel 600 as depicted in FIG. 7), the pressure vessel 500 includes a connection flange 503 and a connection flange 505. As shown in FIG. 7, the connection flanges 503 and 505 couple or connect to corresponding connection flanges 602 and 606 on the spherical pressure vessel 600 (FIG. 6).

Reference is next made to FIG. 6, which shows another pressure vessel suitable for connection in a multiple vessel configuration, for example, as depicted in FIG. 7. The pressure vessel is indicated generally by reference 600 and according to an embodiment comprises a spherical configuration or vessel. As shown, the spherical pressure vessel 600 includes an input connection flange 602 and an input connection flange 606 for connecting to the respective output connection flanges 503 and 505 on the second or middle pressure vessel 500, for example as shown in FIG. 7. As shown, the spherical pressure vessel 600 also includes a gas-out connection flange 604 and a PSV connection flange 608. The pressure vessel 600 also includes a drain connection flange 610. The drain connection flange 610 may be coupled to a steam coil 612 as indicated in FIG. 7. In a single pressure vessel configuration, the connection flange 402 would function as the inlet and the other connection flange 606 would be capped or otherwise sealed.

According to one embodiment, the pressure vessels 400, 500 and 600 comprise 2.5 $m^3$ vessels and the flange connections 404 to 502, 406 to 506, 503 to 602 and 505 to 606 comprise 600 ANSI flanges. This configuration provides the equivalent of a conventional trailer mounted 740 psi, 7.5 $m^3$ unit, with the added benefit that the modular components, i.e. the platform 110 and the pressure vessels 400, 500, 600 are heliportable and can be transported separately by helicopter to a field site and assembled.

According to an aspect of the invention, the modular design of the production testing apparatus 100 provides a configuration which allows the components of the apparatus 100, i.e. the platform base 110 and the pressure vessels 400, 500 and/or 600, to be transported individually or in unassembled form into the field and then assembled or configured in the field. With the weight reductions resulting from the modular design, the components can be transported separately and reassembled at the worksite in the field. According to another embodiment, the pressure vessels are assembled or configured on a trailer and the trailer is transported by road to a site or a staging area for helicopter transport, as described in more detail below with reference to FIGS. 7 to 9. At the staging area, the pressure vessels are taken off the trailer and individually transported by helicopter to the worksite and reassembled on a skid at the worksite.

Figure 8:
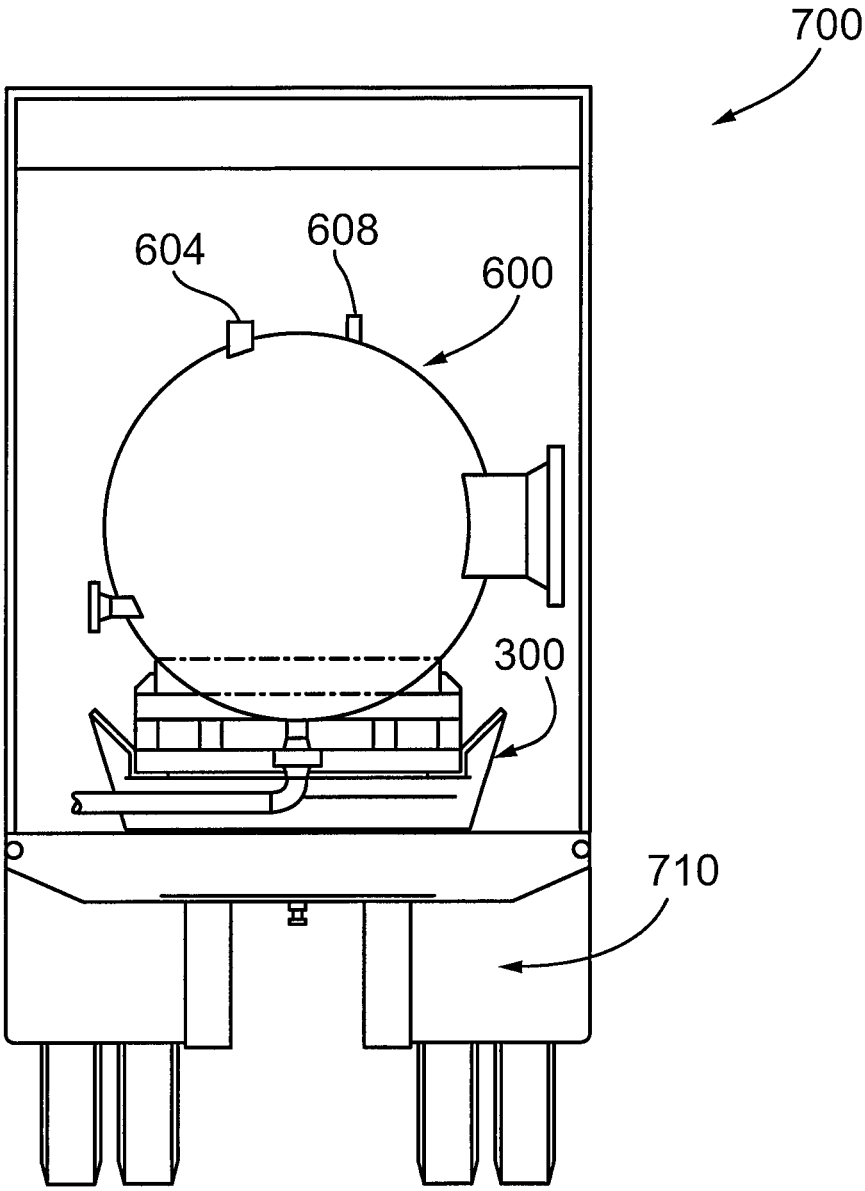
FIG. 8 shows a rear view of the modular apparatus of FIG. 7 according to an embodiment of the invention.
Figure 9:
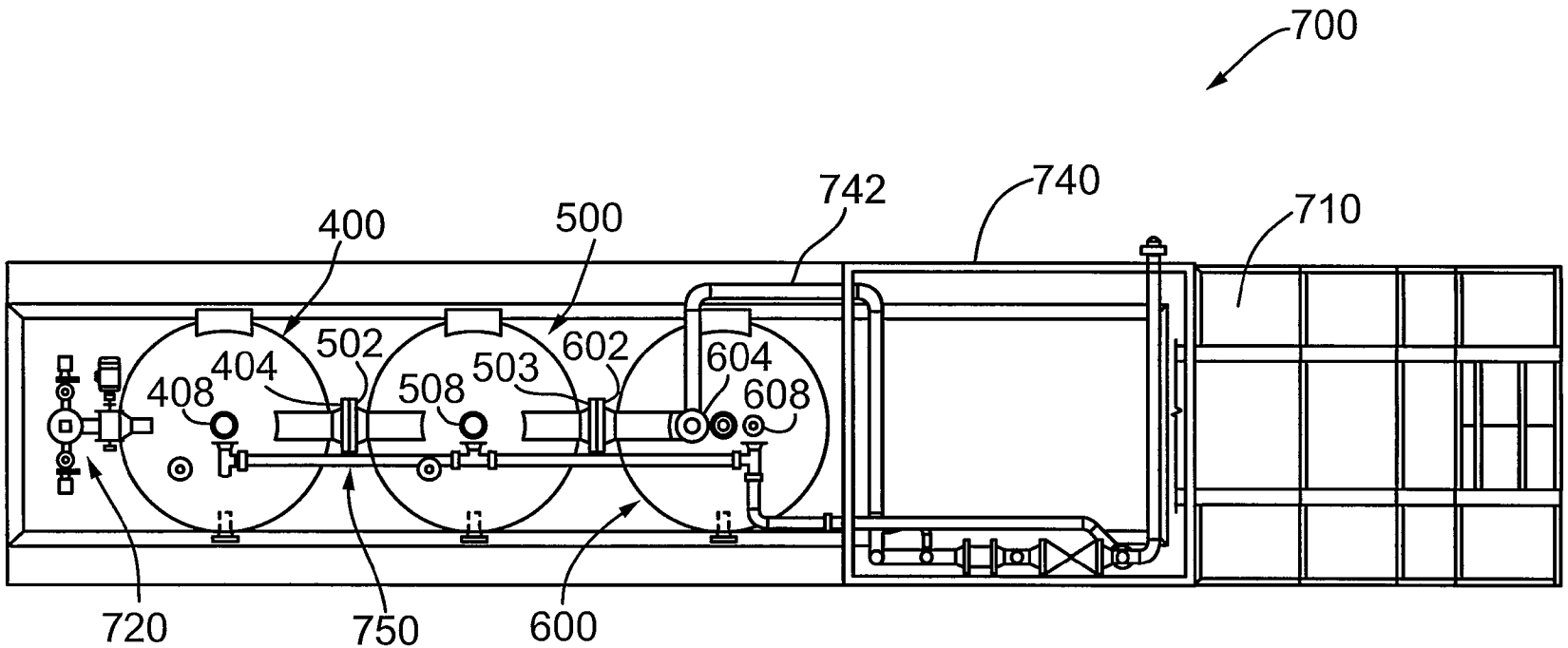
FIG. 9 shows a top view of the modular apparatus of FIG. 7 according to an embodiment of the present invention.

Reference is next made to FIGS. 7 to 9 which show a configuration for a multi-vessel apparatus according to an embodiment of the present invention. The multi-vessel apparatus is indicated generally by reference 700. In accordance with this embodiment, the platform or skid 300 is mounted on a flat-bed trailer indicated by reference 710 and the three pressure vessels 400, 500 and 600 are seated in the respective mounting brackets 314*a* and 314*b* as described above with reference to FIG. 3. The three pressure vessels 400, 500, 600 are also coupled together to allow the apparatus 700 to be moved to a field site and coupled to a well. According to another aspect, the apparatus 700 can be moved to a staging area and disassembled for transport by helicopter to a more remote field site or a field site not accessible by road for a tractor and flat-bed trailer.

As shown in FIG. 7, the inlet connection flange 402 on the pressure vessel 400 is coupled to an output line 720. The output line 720 couples the inlet to a well bore at a field site. The connection flanges 404 and 406 of the pressure vessel 400 are coupled to the respective connection flanges 502 and 506 of the second pressure vessel 500. Similarly, the connection flanges 503 and 505 of the second pressure vessel 500 are coupled to the respective connection flanges 602 and 606 of the third pressure vessel 600.

The "gas-out" connection flange 604 on the third pressure vessel 600 is coupled to an input line 742 on a production well testing module or unit indicated generally by 740. The production well testing module 740 is implemented in known manner to provide the capability for acquiring data for determining well characteristics or parameters, such as, flow rates, maximum flow rates, zone permeability, reservoir pressure, gas and effluent sampling, and other parameters or characteristics as will be familiar to those skilled in the art.

Referring again to FIG. 7, the production well testing module 740 may also include a gas-out flare line indicated generally by reference 750. The gas-out flare line 750 includes flange connectors 752*a*, 752*b*, 752*c* which connect to the respective PSV (Pressure Safety Valve) connection flanges 408, 508, 608 on the respective pressure vessels 400, 500 and 600. In known manner, the pressure safety valves prevent the pressure vessels from becoming over pressurized, i.e. beyond the vessel's maximum pressure rating. The gas-out flare line 750 allows any releases from the pressure vessels to be contained. The respective drain connection flanges 410, 510 and 610 for the pressure vessels 400, 500 and 600 may be coupled to a steam coil (not shown).

According to another aspect of the invention, the spherical configuration of the pressure vessels 400, 500 or 600 provides a tank or vessel design which is approximately twice as strong as a cylindrical pressure vessel. This means that the wall thickness of the spherical pressure vessel 400, 500, 600 can be reduced to provide further weight savings, thereby making the pressure vessels 400, 500, 600 and the platform base 110 (or 300) suitable for helicopter transport and field assembly.

As described above with reference to FIGS. 1 to 2, the base or platform 110 according to an embodiment includes the mounting brackets 114. According to an aspect of the invention, each of the mounting brackets 114 comprises a trough configuration which is dimensioned to receive and seat a corresponding base support member on the pressure vessel. For example, as shown in FIG. 4, the spherical pressure vessel 400 includes a pair of base support members 420 and 422. As shown in FIGS. 1 to 2, the mounting brackets 114 are raised above the platform 110 (i.e. the base 112) to accommodate fittings on the underside of the vessel 400, for example, the drain flange connection 410.

Referring back to FIG. 1, the angled configuration of the mounting brackets 114 further facilitates the assembly of the apparatus 700 in the field. For example, the apparatus 700 is transported on the trailer 710 to a staging area. At the staging area, the pressure vessels 400, 500, 600 and the platform 110 are disconnected and the vessels are removed from the platform 110. The platform 110 is then lifted and transported by helicopter, i.e. "heliported", to the field site and placed on the ground. Next, the spherical pressure vessel 400 is heliported to the site and the vessel 400 is positioned over the platform 110, lined up with the mounting brackets 114 and lowered into place. The configuration of the mounting brackets 114 (i.e. the outwardly angled walls) allow the pressure vessel 400 to be guided into place under the force of gravity and with minimal intervention or guiding by personnel positioned under the helicopter, which as will be appreciated can be a dangerous working environment or situation. It will be appreciated that according to one aspect, the self aligning insertion brackets 114 and the mounting or seating trough facilitate the positioning and mounting of the individual pressure vessels thereby improving worker safety while working under suspended loads. To facilitate the transport and assembly, the pressure vessels also include multiple lift point attachments, for example, lugs or fastening means for accepting eye-bolts or other types of connectors for lifting the vessels, for example, on a sling under a helicopter.

The present invention may be embodied in other specific forms without departing from the spirit or essential characteristics thereof. Certain adaptations and modifications of the invention will be obvious to those skilled in the art. Therefore, the presently discussed embodiments are considered to be illustrative and not restrictive, the scope of the invention being indicated by the appended claims rather than the foregoing description, and all changes which come within the meaning and range of equivalency of the claims are therefore intended to be embraced therein.

What is claimed is:

1. A field transportable modular well testing apparatus for production testing at a field site, said apparatus comprising:

a transportable platform, said transportable platform including a base for positioning on the field site and further including one or more mounting brackets and each of said one or more mounting brackets comprising a support surface;

one or more production well testing pressure vessels, each of said one or more production well testing pressure vessels including a support member, and said one or more support surfaces being configured for supporting at least a portion of said production well testing pressure vessel support member;

each of said one or more mounting brackets including a guide configured to guide said support member into position from an elevated position onto said support surface; and wherein each of said one or more mounting brackets comprises a longitudinal arrangement having a lower section configured with said support surface and having an upper section wider than said lower section, and said guide comprising an outwardly sloping surface connecting at least a portion of said lower section and said upper section.

2. The field transportable modular well testing apparatus as claimed in claim 1, wherein said one or more production well testing pressure vessels comprise a substantially spherical shaped vessel.

3. The field transportable modular well testing apparatus as claimed in claim 1, wherein each of said transportable platform and each of said one or more production well testing pressure vessels include a plurality of attachment points, each of said attachment points being adapted for attaching a sling for lifting and moving said transportable platform and said one or more production well testing pressure vessels.

4. The field transportable modular well testing apparatus as claimed in claim 3, wherein said sling comprises a load sling for a helicopter and each of said transportable platform and said one or more production well testing pressure vessels having an individual weight suitable for transport by helicopter.

5. The field transportable modular well testing apparatus as claimed in claim 1, further including a wear plate attached to at least a portion of said support surface for each of said one or more mounting brackets.

6. A field transportable well production testing apparatus comprising:

a transportable platform and said platform including one or more mounting brackets and each of said one or more mounting brackets comprising a support surface;

one or more spherical production well testing pressure vessels, each of said one or more spherical production well testing pressure vessels including a support member, and said support surface for each of said one or more mounting brackets being configured for supporting at least a portion of said production well testing pressure vessel support member; and wherein said transportable platform and said one or more spherical pressure vessels include a plurality of attachment points for attaching a helicopter sling.

7. The field transportable well production testing apparatus as claimed in claim 6, wherein said each of said mounting brackets includes a guide configured to guide said one or more spherical production well testing pressure vessels into a seated position on said support surface from a position above said transportable platform.

8. The field transportable well production testing apparatus as claimed in claim 6, wherein said platform and each of said one or more spherical pressure vessels are configured to be heliportable.

9. The field transportable well production testing apparatus as claimed in claim 8, wherein said one or more spherical pressure vessels comprise three spherical pressure vessels, and each of said spherical pressure vessels is configured to be connected together to form a 740 psi apparatus.

10. The field transportable modular well testing apparatus as claimed in claim 6, further including a wear plate attached to at least a portion of said support surface for each of said one or more mounting brackets.

* * * * *